US010538361B2

(12) United States Patent
Nakamura

(10) Patent No.: US 10,538,361 B2
(45) Date of Patent: Jan. 21, 2020

(54) CRATING ARRANGEMENT

(71) Applicant: KYOCERA Document Solutions Inc., Osaka (JP)

(72) Inventor: Toshiyuki Nakamura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 15/921,216

(22) Filed: Mar. 14, 2018

(65) Prior Publication Data

US 2018/0282018 A1 Oct. 4, 2018

(30) Foreign Application Priority Data

Mar. 30, 2017 (JP) ..... 2017-067027

(51) Int. Cl.
*B65D 19/14* (2006.01)
*B65D 19/38* (2006.01)
*B65D 19/06* (2006.01)

(52) U.S. Cl.
CPC ..... *B65D 19/14* (2013.01); *B65D 19/06* (2013.01); *B65D 19/38* (2013.01); *B65D 2519/00024* (2013.01); *B65D 2519/00029* (2013.01); *B65D 2519/00034* (2013.01); *B65D 2519/00059* (2013.01); *B65D 2519/00064* (2013.01); *B65D 2519/00069* (2013.01); *B65D 2519/0081* (2013.01); *B65D 2519/00094* (2013.01); *B65D 2519/00099* (2013.01); *B65D 2519/00104* (2013.01); *B65D 2519/00159* (2013.01); *B65D 2519/00199* (2013.01); *B65D 2519/00203* (2013.01); *B65D 2519/00208* (2013.01); *B65D 2519/00273* (2013.01); *B65D 2519/00293* (2013.01); *B65D 2519/00323* (2013.01);

(Continued)

(58) Field of Classification Search
CPC ..... B65D 15/24; B65D 71/0088; B65D 19/06
USPC ..... 206/597, 600, 386, 577, 701, 335, 722, 206/599, 509, 319; 53/244, 443, 448; 220/1.5; 108/55.3, 21.11, 56.3
See application file for complete search history.

(56) References Cited

U.S. PATENT DOCUMENTS 3,756,498 A * 9/1973 Anderson ..... B65D 19/20 206/386
4,383,609 A * 5/1983 Lochmiller ..... B65D 19/06 206/386

(Continued)

FOREIGN PATENT DOCUMENTS

JP 2001-171666 A 6/2001
JP 2006-341896 A 12/2006

*Primary Examiner* — J. Gregory Pickett
*Assistant Examiner* — Tia Cox
(74) *Attorney, Agent, or Firm* — Stein IP, LLC

(57) ABSTRACT

A crating arrangement has a pallet, a sleeve, a top board, and a plurality of fastening belts. The pallet has a rectangular shape in a plan view, and has a bottom board, a support board arranged opposite the bottom board across a predetermined distance, and a plurality of beams fixed to the support board and the bottom board. The sleeve is made of a cardboard sheet in a cornered-column shape, and is placed over the pallet to wrap a side surface of a crated object placed on the support board. The top board has a rectangular shape, and is placed on a top end part of the sleeve. With the fastening belts, the pallet and the crated object are fastened together and the pallet, the sleeve, and the top board are fastened together.

5 Claims, 9 Drawing Sheets

(52) U.S. Cl.
CPC ..... *B65D 2519/00333* (2013.01); *B65D 2519/00373* (2013.01); *B65D 2519/00497* (2013.01); *B65D 2519/00621* (2013.01); *B65D 2519/00641* (2013.01); *B65D 2519/00661* (2013.01); *B65D 2519/00711* (2013.01)

(56) References Cited

U.S. PATENT DOCUMENTS

| | | | | | |
|---|---|---|---|---|---|
| 4,426,015 | A * | 1/1984 | Preston | B65D 77/061 | 206/386 |
| 4,938,350 | A * | 7/1990 | Grigsby | B65D 85/68 | 206/319 |
| 4,955,474 | A * | 9/1990 | Mattingly | B65D 85/68 | 206/320 |
| 5,036,979 | A * | 8/1991 | Selz | B65D 19/20 | 206/386 |
| 5,069,338 | A * | 12/1991 | Grigsby | B65D 5/446 | 206/319 |
| 5,323,911 | A * | 6/1994 | Johnston | B65D 19/16 | 206/526 |
| 5,938,037 | A * | 8/1999 | Essary | B65D 19/385 | 206/600 |
| 6,019,226 | A * | 2/2000 | Zajdlik | B65D 19/16 | 108/55.1 |
| 6,581,769 | B2 * | 6/2003 | Nist | B65D 19/20 | 108/51.11 |
| 8,061,521 | B1 * | 11/2011 | Lowry | B65D 19/44 | 206/576 |
| 8,256,615 | B2 * | 9/2012 | Goda | B65D 19/06 | 108/55.1 |
| 2001/0051079 | A1 | 12/2001 | Arai | 410/77 | |

* cited by examiner

CRATING ARRANGEMENT

INCORPORATION BY REFERENCE

This application is based upon and claims the benefit of priority from the corresponding Japanese Patent Application No. 2017-067027 filed on Mar. 30, 2017, the entire contents of which are incorporated herein by reference.

BACKGROUND

The present disclosure relates to a crating arrangement in which, for example, a heavy product such as an electronic apparatus or the like is crated.

Conventionally, wooden crates have been used as crating arrangements in which a large and heavy product is crated to be carried. However, although the wooden crates excel in durability, the wooden crates are not only heavy and expensive for disposal but also pose a problem from the perspective of resource saving. Boards are fixed with nails, and this requires a significant amount of time for crating and uncrating and poses the danger of an operator getting hurt with nails or wood splinters.

As a solution, crating arrangements made of cardboard which are inexpensive for disposal and which cause less pollution and less environmental burden are widely used. For example, a cardboard case with a pallet is known in which a collapsible slope for placing a product with casters is swingably coupled to an end part of the top surface of the pallet. With the cardboard case with a pallet, it is unnecessary to place the cardboard case having a product packed therein again on another pallet; this makes it easy to pack and carry products and the like, particularly large ones.

A cardboard case as mentioned above is closed with adhesive tape or the like, and thus, after the cardboard case is opened once, its appearance deteriorates due to creases or breakage; this inconveniently makes it impossible to use the cardboard case repeatedly. When the cardboard cases are stacked and carried, to improve stacking efficiency by efficient use of space, so-called tiered stacking is performed by stacking the cardboard cases on top of each other. However, the cardboard cases have a lower strength than that of wooden crates, and thus the top boards may sag when the cardboard cases are carried or kept in storage; this inconveniently makes it impossible to stably place products.

As a solution, goods stocking devices have been proposed which allows efficient storage and transport of goods and which can be used repeatedly. For example, a goods stocking device (transport rack) is known which includes a goods placement member on which goods are placed, a plurality of pillars that can be fitted to the goods placement member, and a coupling member that couples the pillars together, and a method of collapsing pillars is also known.

SUMMARY

According to one aspect of the present disclosure, a crating arrangement includes a pallet, a sleeve, a top board, and a plurality of fastening belts. The pallet has a rectangular shape in a plan view, and includes a bottom board, a support board arranged opposite the bottom board across a predetermined distance, and a plurality of beams fixed to the support board and the bottom board. The sleeve is made of a cardboard sheet in the shape of a cornered column, and is placed over the pallet to wrap a side surface of a crated object placed on the support board. The top board has a rectangular shape, and is placed on a top end part of the sleeve. With the fastening belts, the pallet and the crated object are fastened together and the pallet, the sleeve, and the top board are fastened together.

Further features and advantages of the present disclosure will become apparent from the description of embodiments given below.

DETAILED DESCRIPTION

Figure 1:
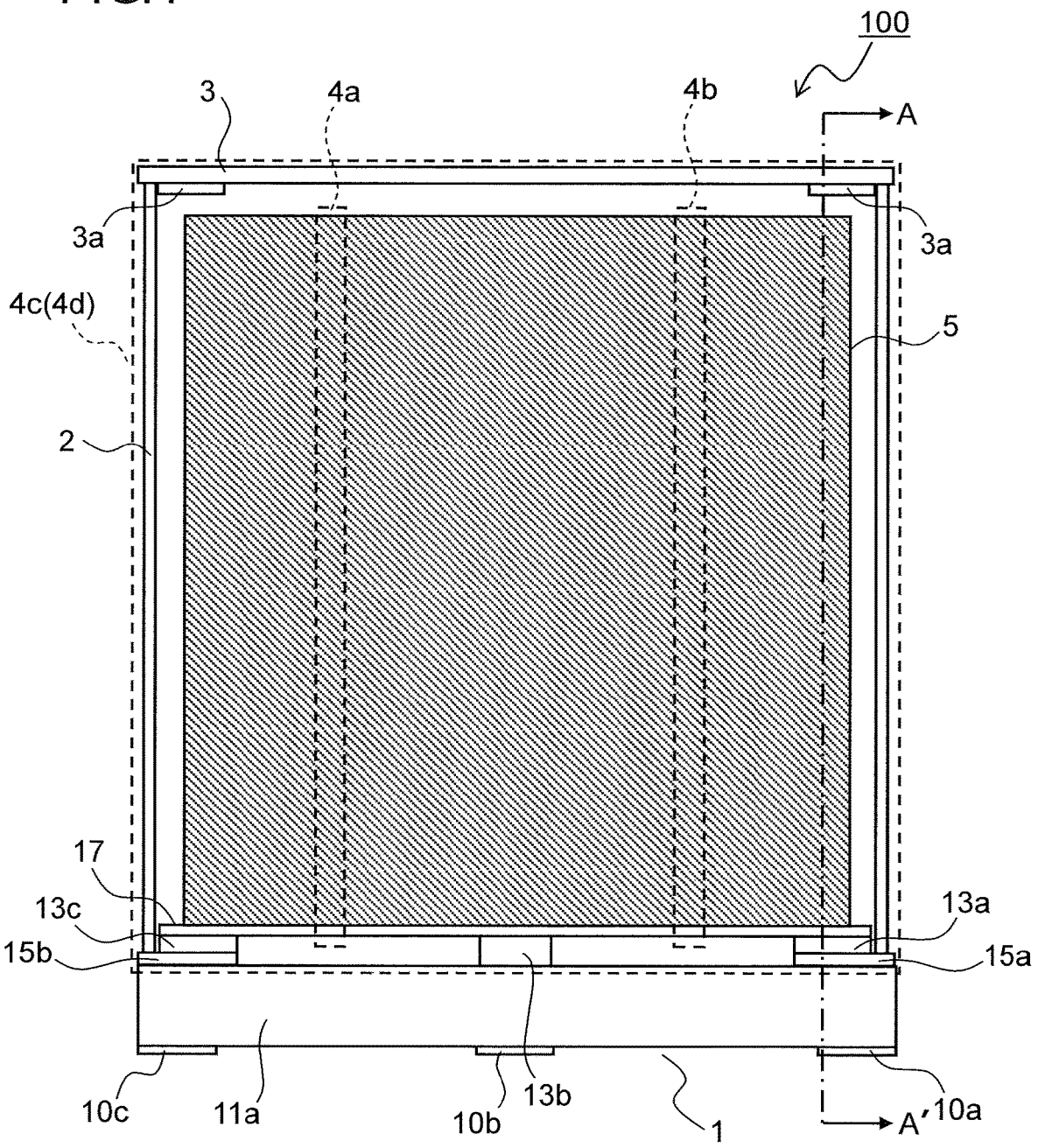
FIG. 1 is a front sectional view showing a state where a crated object is crated in a crating arrangement according to one embodiment of the present disclosure.
Figure 2:
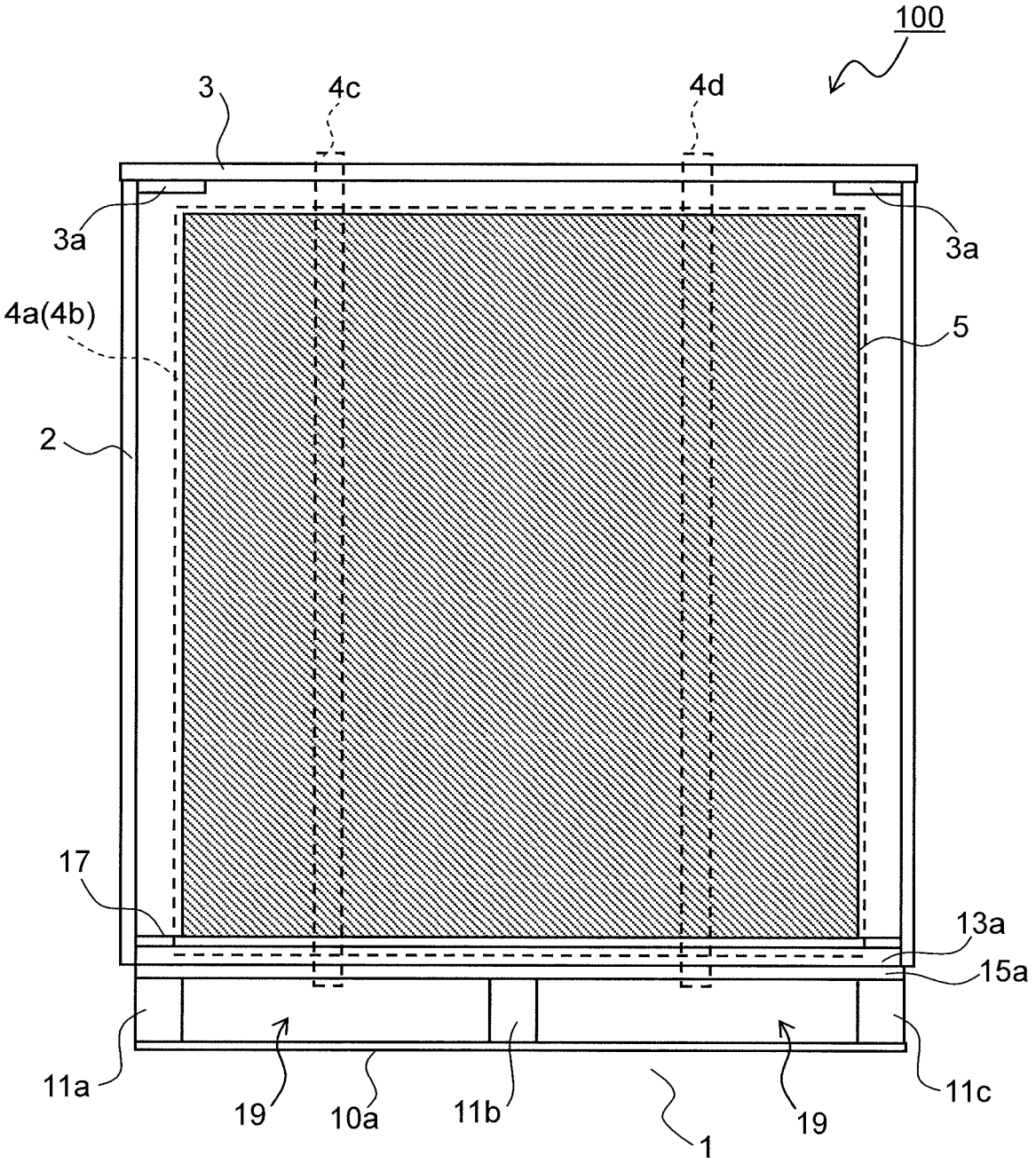
FIG. 2 is a side sectional view showing a state where the crated object is crated in the crating arrangement according to the embodiment.
Figure 3:
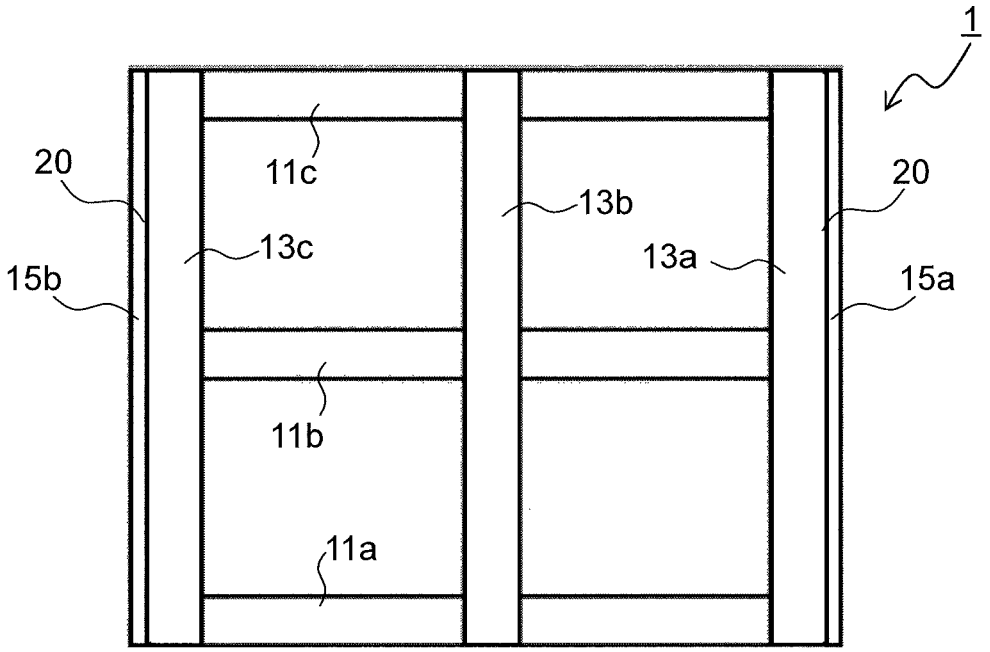
FIG. 3 is a plan view showing a first structure example of a pallet constituting the crating arrangement according to the embodiment.
Figure 4:
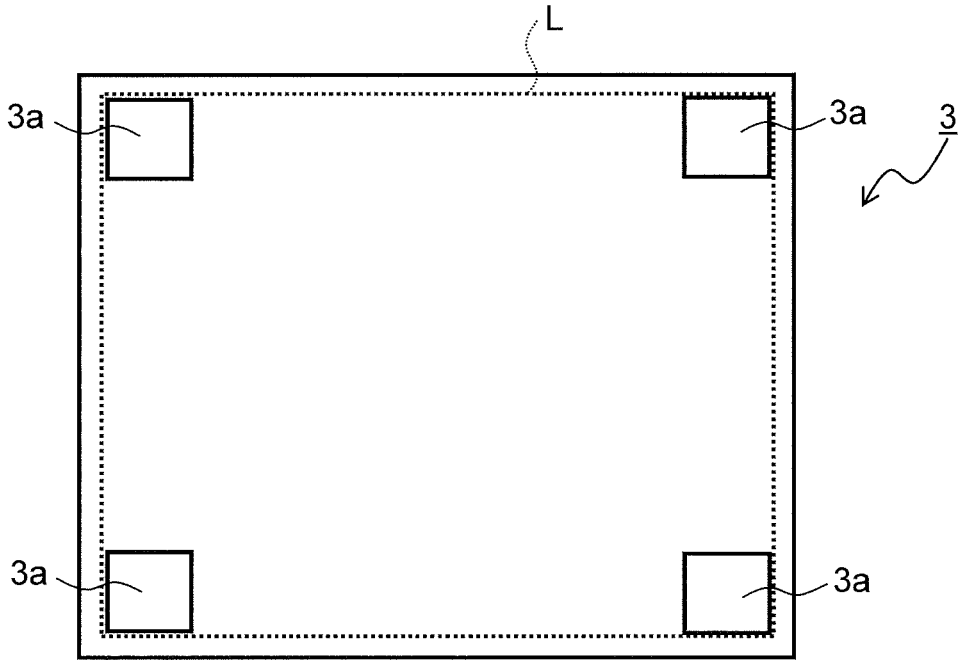
FIG. 4 is a plan view of a top board constituting the crating arrangement according to the embodiment as seen from the reverse side of the top board.

Hereinafter, an embodiment of the present disclosure will be described with reference to the accompanying drawings. FIG. 1 is a front sectional view showing a state where a crated object 5 is crated in a crating arrangement 100 according to one embodiment of the present disclosure. FIG. 2 is a side sectional view (sectional view across line A-A' in FIG. 1 as seen from the direction indicated by arrows A and A') showing a state where the crated object 5 is crated in the crating arrangement 100 according to this embodiment. FIG. 3 is a plan view showing a first structure example of a pallet 1 constituting the crating arrangement 100 according to this embodiment. FIG. 4 is a plan view of a top board 3 constituting the crating arrangement 100 according to this embodiment, as seen from the reverse side of the top board 3. FIG. 3 shows a state with a support board 17 removed from the pallet 1.

With the crating arrangement 100, the crated object 5, which is a product such as an image forming apparatus having been packed in a cardboard case or the like, is crated so that the crated object 5 can be carried on a forklift, a pallet jack, or the like. The crating arrangement 100 includes the pallet 1, a sleeve 2, the top board 3, first fastening belts 4*a* and 4*b*, and second fastening belts 4*c* and 4*d*.

The pallet 1 is made of wood, and includes three bottom boards 10*a* to 10*c*, three leg beams 11*a* to 11*c*, three horizontal beams 13*a* to 13*c*, a pair of flat boards 15*a* and 15*b*, and the support board 17. The bottom boards 10*a* to 10*c* make contact with the placement surface. The leg beams 11*a* to 11*c* are fixed perpendicularly to the top surfaces of the three bottom boards 10*a* to 10*c*. The horizontal beams 13*a* to 13*c* are fixed perpendicularly to the leg beams 11*a* to 11*c*. The flat boards 15*a* and 15*b* are fixed to opposite end parts of the leg beams 11*a* to 11*c* so as to bridge them, and underlap the horizontal beams 13*a* and 13*c*. The support board 17 is fixed to the top surfaces of the horizontal beams 13*a* to 13*c*. The support board 17 has the same rectangular shape as that formed by connecting the outer circumferential edges of the horizontal beams 13*a* to 13*c*. In a side surface of the pallet 1, there are formed arm insertion holes 19 surrounded by the bottom boards 10*a* to 10*c*, the leg beams 11*a* to 11*c*, and the horizontal beams 13*a* to 13*c*.

The sleeve 2 is formed of a cardboard sheet in the shape of a cornered column, and is placed over the pallet 1 to wrap the side surface of the crated object 5. The length of the inner circumference of the sleeve 2 (indicated by the dotted line L in FIG. 4) is slightly larger than the length of the outer circumference of the rectangular shape formed by connecting the outer circumferential edges of the horizontal beams 13*a* to 13*c*. The cardboard sheet forming the sleeve 2 has its grain direction (the longitudinal direction of the thin tubes formed by flat sheet and corrugated sheets) aligned with the up-down direction of the sleeve 2.

The top board 3 is made of wood, and is placed on a top end part 2*b* (see FIG. 6) of the sleeve 2. As shown in FIG. 4, to the reverse side of the top board 3, engagement pieces 3*a* are fixed. The engagement pieces 3*a* are fixed to the rectangular top board 3, slightly inward of the edges at its four corners, and engage with the inner circumferential edge of the sleeve 2 when the top board 3 is placed on the top end part 2*b* of the sleeve 2. With the first fastening belts 4*a* and 4*b*, the pallet 1 and the crated object 5 are fastened together. With the second fastening belts 4*c* and 4*d*, the pallet 1, the sleeve 2, and the top board 3 are fastened together. As the first fastening belts 4*a* and 4*b* and the second fastening belts 4*c* and 4*d*, for example, crating belts with a thickness of one millimeter made of polyethylene terephthalate are used.

Figure 5:
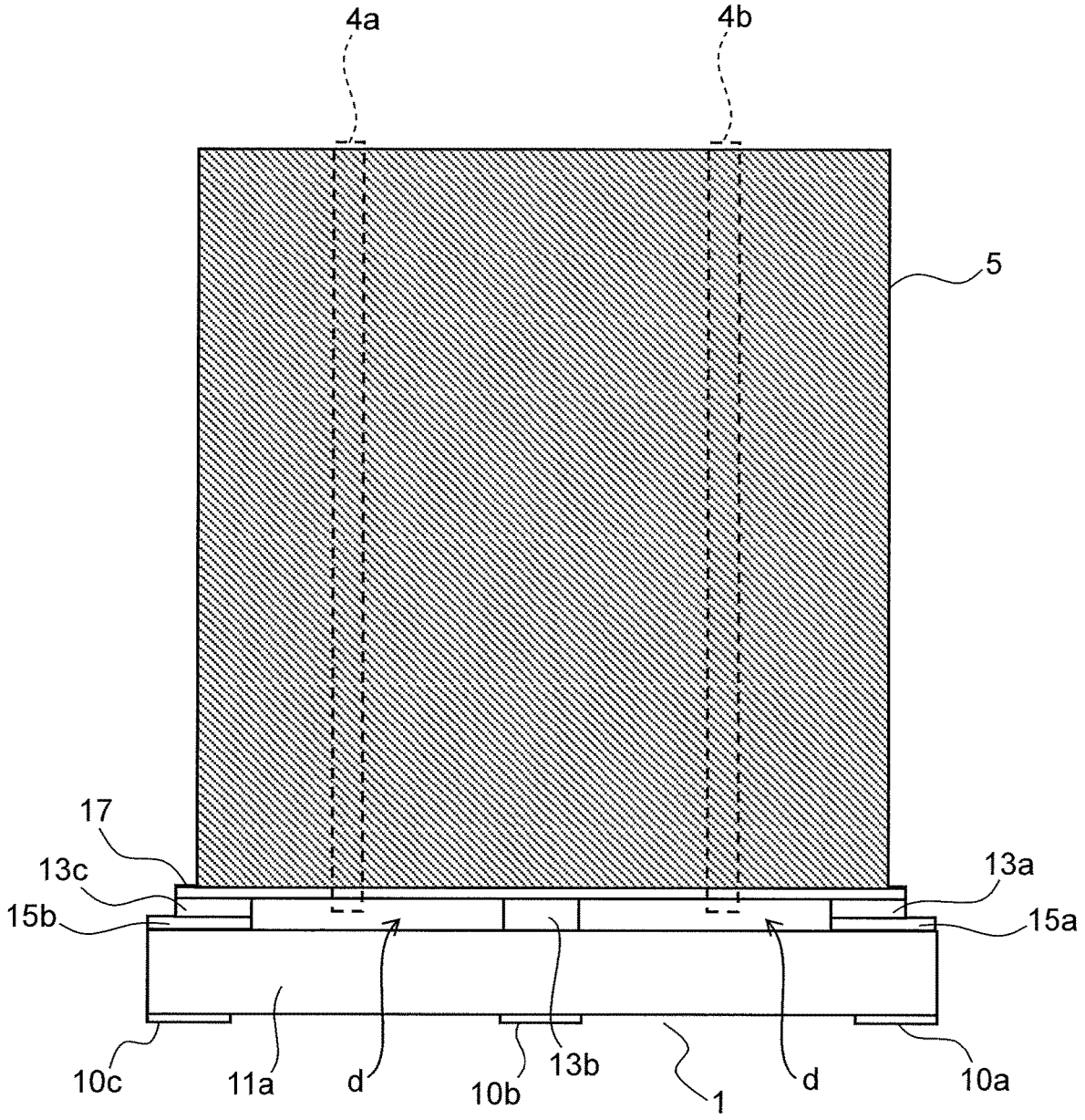
FIG. 5 is a side sectional view showing a step of crating with the crating arrangement according to the embodiment, showing a state where the crated object is placed on a support board of the pallet.

Now, a description will be given of a crating method using the crating arrangement 100. First, as shown in FIG. 5, the crated object 5 is placed on the support board 17 of the pallet 1. Then, the first fastening belts 4*a* and 4*b* are inserted into clearances d between the leg beams 11*a* to 11*c* and the support board 17 of the pallet 1, are wound around over the crated object 5, and are then each fastened annularly. In this way, the crated object 5 is fixed to the pallet 1. The first fastening belts 4*a* and 4*b* are fastened, for example, as follows. Using a commercially available belt fastening machine, with a predetermined tension applied to a belt, with a metal fasting member, opposite end parts of the belt are placed over each other and are fastened to be fixed together; then the surplus parts of the belt at its ends are cut off.

Figure 6:
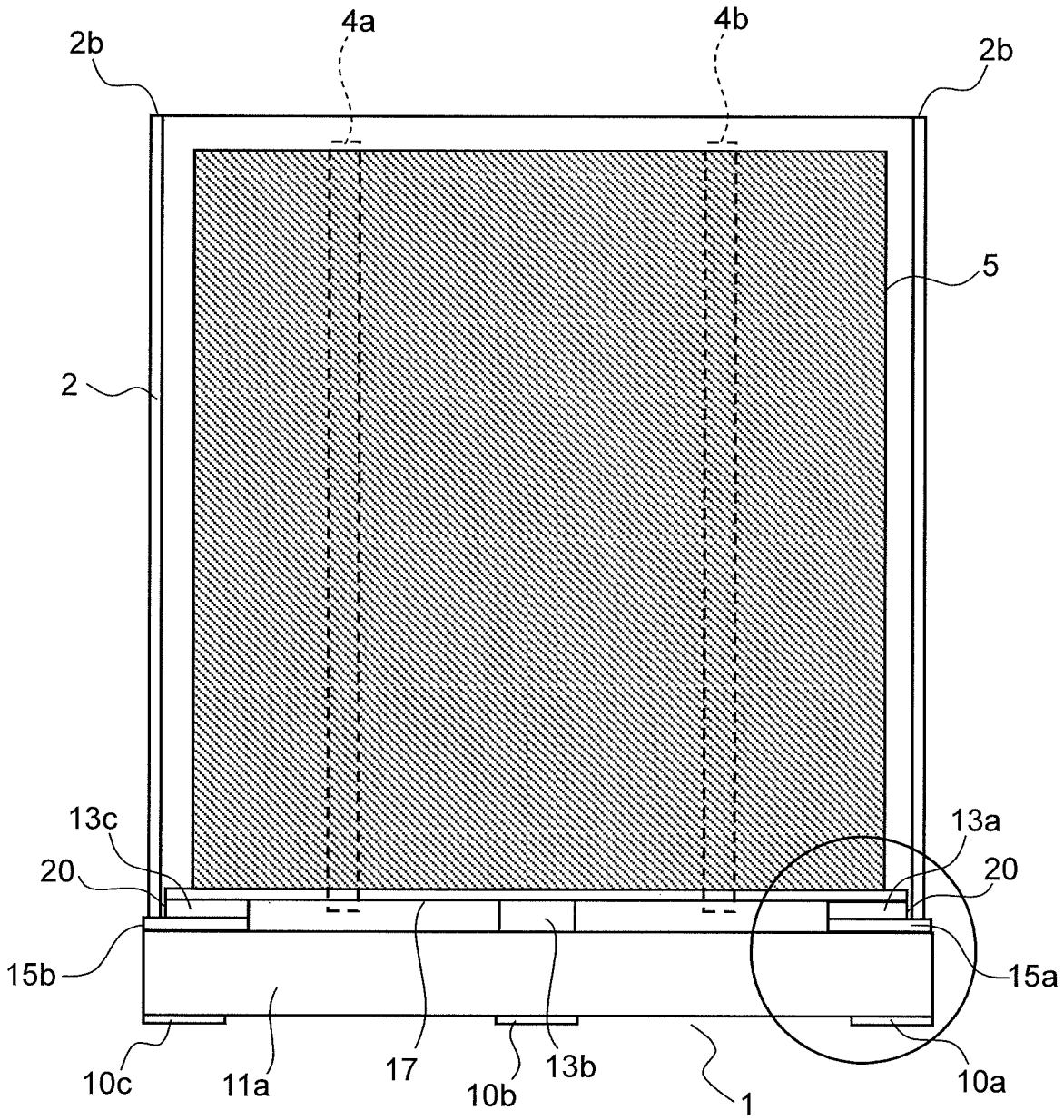
FIG. 6 is a side sectional view showing a step of crating with the crating arrangement according to the embodiment, showing a state where the crated object placed on the support board is covered with a sleeve from above.
Figure 7:
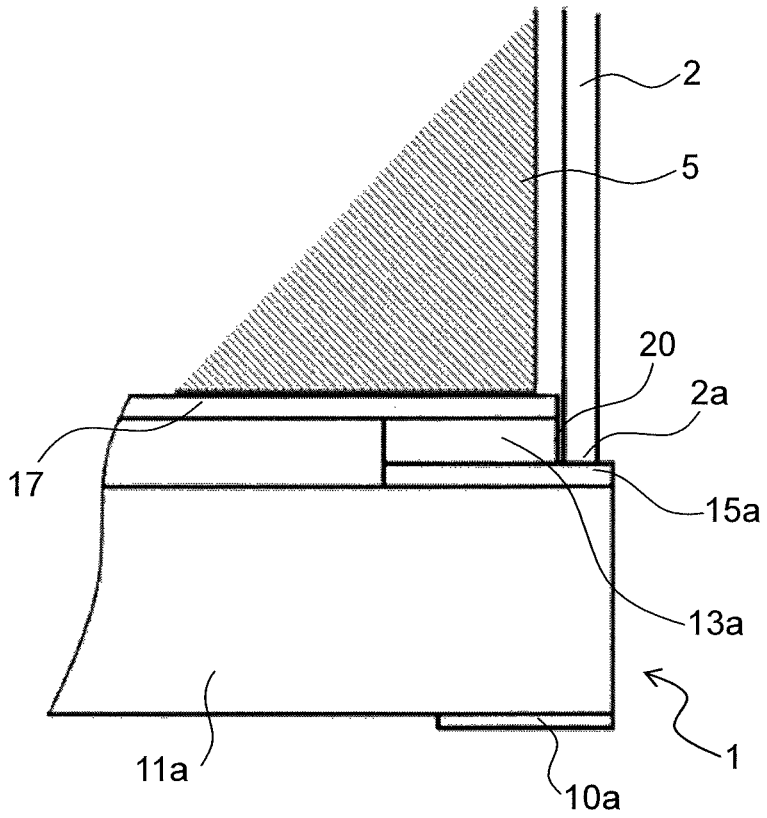
FIG. 7 is an enlarged view of a place where the pallet and the sleeve are in contact with each other with the sleeve placed over the pallet.

Next, as shown in FIG. 6, the crated object 5 is covered with the sleeve 2 from above. FIG. 7 is an enlarged view of a place (inside the circle in FIG. 6) where the pallet 1 and the sleeve 2 are in contact with each other with the sleeve 2 placed over the pallet 1. Although FIG. 7 illustrates only the right-side (the flat board 15*a*-side) structure in FIG. 6, the left-side (the flat board 15*b*-side) structure is quite the same. As shown in FIG. 7, the flat boards 15*a* and 15*b* of the pallet 1 each have a side edge in its longitudinal direction (an edge extending in the up-down direction in FIG. 3) protruding from an edge of the support board 17 to a position underlapping a bottom end part 2*a* of the sleeve 2. The bottom end part 2*a* of the sleeve 2 is supported on the flat boards 15*a* and 15*b* of the pallet 1. The inner circumferential edge of the sleeve 2 engages with a stepped portion 20 formed by the horizontal beams 13*a* and 13*c* and the support board 17. This makes it easy to position the sleeve 2 with respect to the pallet 1.

Figure 8:
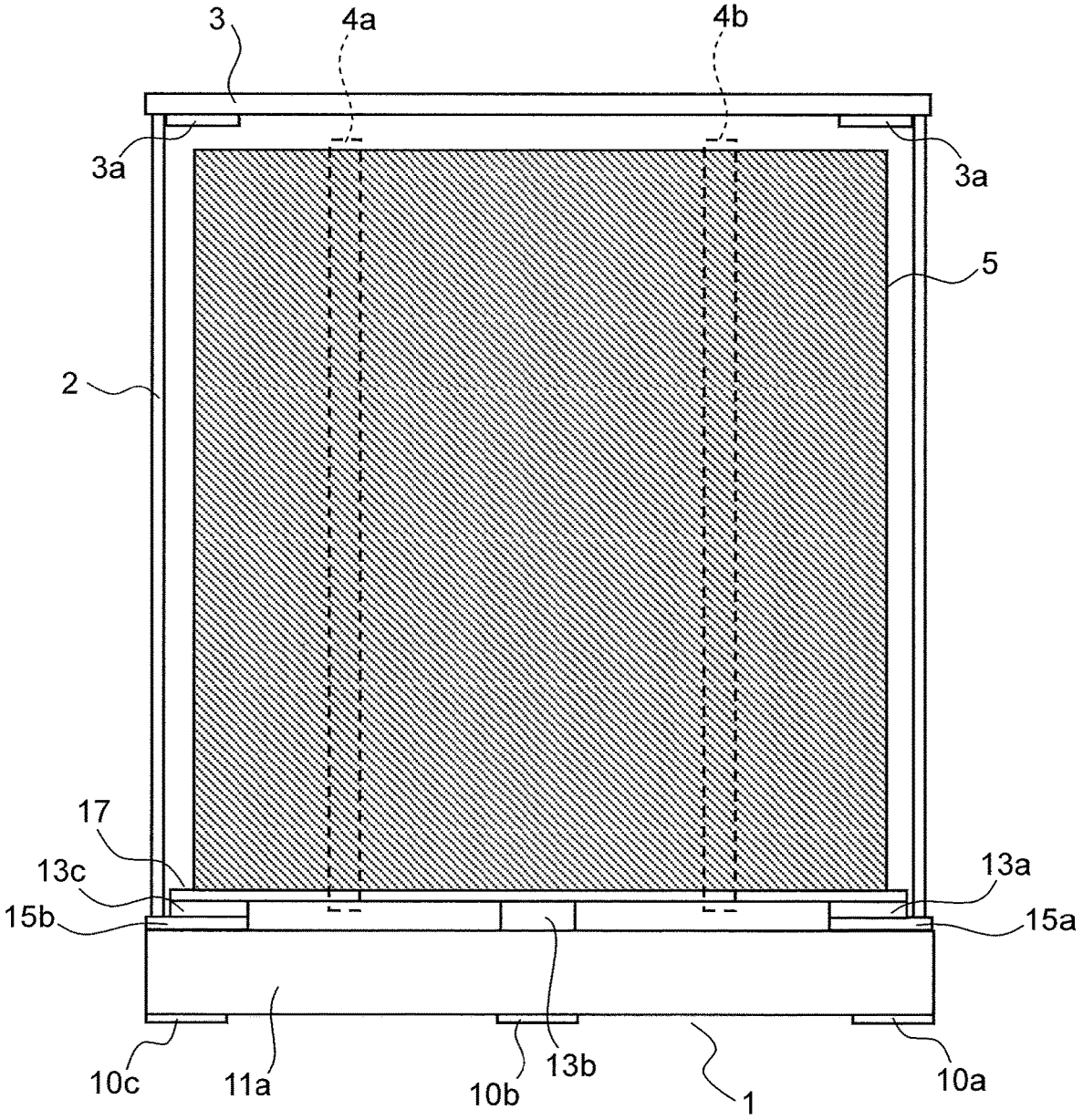
FIG. 8 is a side sectional view showing a step of crating with the crating arrangement according to the embodiment, showing a state where a top board is placed on a top end part of the sleeve.

Next, as shown in FIG. 8, the top board 3 is placed on the top end part 2*b* (see FIG. 6) of the sleeve 2. Engaging the engagement pieces 3*a* fixed to the reverse side of the top board 3 with the inner circumferential edge of the sleeve 2 makes it easy to position the top board 3 with respect to the sleeve 2. Finally, the second fastening belts 4*c* and 4*d* are inserted into the arm insertion holes 19 in the pallet 1, are wound around over the top board 3, and are then each fastened annularly. In this way, the sleeve 2 and the top board 3 are fixed to the pallet 1. The second fastening belts 4*c* and 4*d* are fastened in a similar manner as the first fastening belts 4*a* and 4*b*.

Here, as shown in FIG. 7, the bottom end parts 2*a* of the sleeve 2 facing away from each other are supported on the flat boards 15*a* and 15*b*. Thus, there is no danger of the bottom end parts 2*a* of the sleeve 2 biting into the leg beams 11*a* to 11*c* and the horizontal beams 13*a* to 13*c* when the sleeve 2 and the top board 3 are fastened to the pallet 1 with the second fastening belts 4*c* and 4*d*. Thus, it is possible to prevent deformation of the sleeve 2 and loosening of the second fastening belts 4*c* and 4*d* resulting from the biting of the bottom end parts 2*a*.

When the crating arrangement 100 in which the crated object 5 has been crated is carried, the arms of a forklift or a pallet jack are inserted into the arm insertion holes 19 formed in the pallet 1 to lift up and carry the crating arrangement 100. With such a crating arrangement 100, it is unnecessary to pack a product, as the crated object 5, in a cardboard case or the like and then place it on the pallet 1; this makes it easy to crate and carry products and the like, particularly large ones.

With the bottom end part 2*a* of the sleeve 2 supported on the pallet 1 and with the top board 3 arranged on the top end part 2*b* of the sleeve 2, the sleeve 2 is held between the pallet 1 and the top board 3. The sleeve 2 has its cardboard sheet grain direction aligned parallel to its up-down direction, and has a high compressive strength in the up-down direction. Thus, even when another crating arrangement 100 is stacked on top of the top board 3, there is no danger of the sleeve 2 squashing. As the sleeve 2, a cardboard sheet having a higher compressive strength in a multilayer structure may be used. It is also possible to use a plurality of the sleeves 2 overlapping each other in a nested structure to increase the compressive strength.

When the crating arrangement 100 is opened, the second fastening belts 4*c* and 4*d* are cut to release the fixing among the pallet 1, the sleeve 2, and the top board 3. Then, the top board 3 and the sleeve 2 are removed, and then the first fastening belts 4*a* and 4*b* are cut to release the fixing between the pallet 1 and the crated object 5. Thus, it is possible to open the crating arrangement 100 simply by cutting the fastening belts 4*a* to 4*d* with scissors or a knife; this eliminates the need to pull out nails and remove boards as with conventional wooden frame crating, and helps significantly reduce the time required for opening. There is no longer a danger of an operator getting hurt with nails or wood splinters.

The pallet 1, the sleeve 2, and the top board 3 are fixed together only with the fastening belts 4*a* to 4*d* without adhesive tape or nails; this makes it easy to separate the pallet 1 and the top board 3. Thus, even after the crating arrangement 100 has been opened once, its appearance does not deteriorate due to creases or brakeage, and thus the crating arrangement 100 can be used repeatedly. It is also easy to separate, for disposal, the pallet 1 and the top board 3, which are made of wood, and the sleeve 2, which is made of paper; this improves recyclability.

Figure 9:
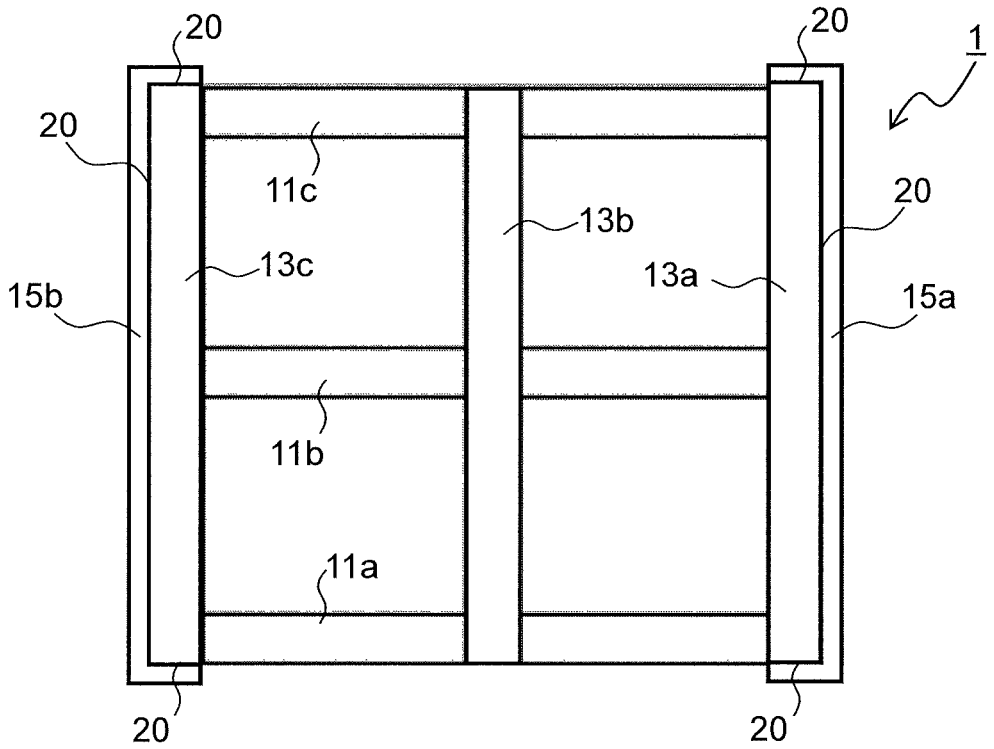
FIG. 9 is a plan view showing a second structure example of the pallet used in the crating arrangement according to the embodiment.

FIG. 9 is a plan view showing a second structure example of the pallet 1 constituting the crating arrangement 100 according to this embodiment. Like FIG. 3, FIG. 9 and FIG. 10, of which the latter will be described later, show a state with the support board 17 removed from the pallet 1. In the second structure example shown in FIG. 9, opposite end parts of each of the flat boards 15*a* and 15*b* in its longitudinal direction protrude from the edges (edges in the up-down direction in FIG. 9) of the support board 17 facing away from each other to positions underlapping the bottom end part 2*a* of the sleeve 2.

According to the second structure example, in addition to the bottom end parts 2*a* at two sides (two sides in the left-right direction in FIG. 9) of the sleeve 2 facing away from each other, bottom end parts 2*a* at two sides (two sides in the up-down direction in FIG. 9) orthogonal to the above-mentioned two sides are also supported on the flat boards 15*a* and 15*b*. Thus, it is possible to prevent deformation of the sleeve 2 and loosening of the second fastening belts 4*c* and 4*d* resulting from the biting of the bottom end parts 2*a* more effectively than with the first structure example. The stepped portions 20 are formed on the pallet 1 at its four edges, and thus the sleeve 2 is positioned with respect to the pallet 1 more easily than with the first structure example.

Figure 10:
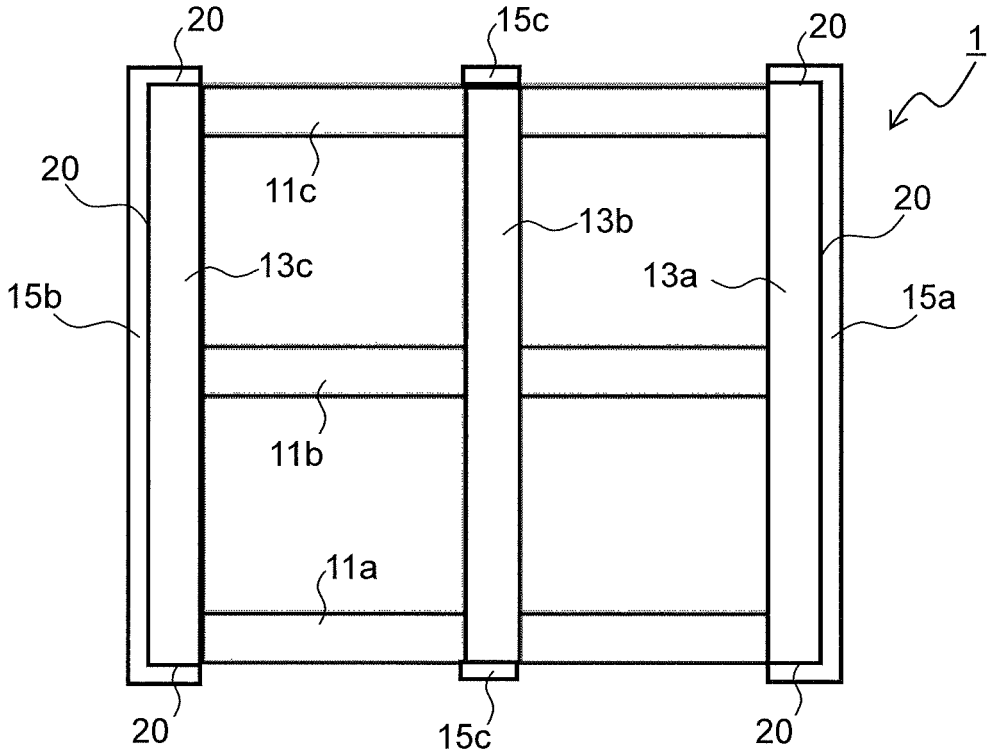
FIG. 10 is a plan view showing a third structure example of the pallet used in the crating arrangement according to the embodiment.
Figure 11:
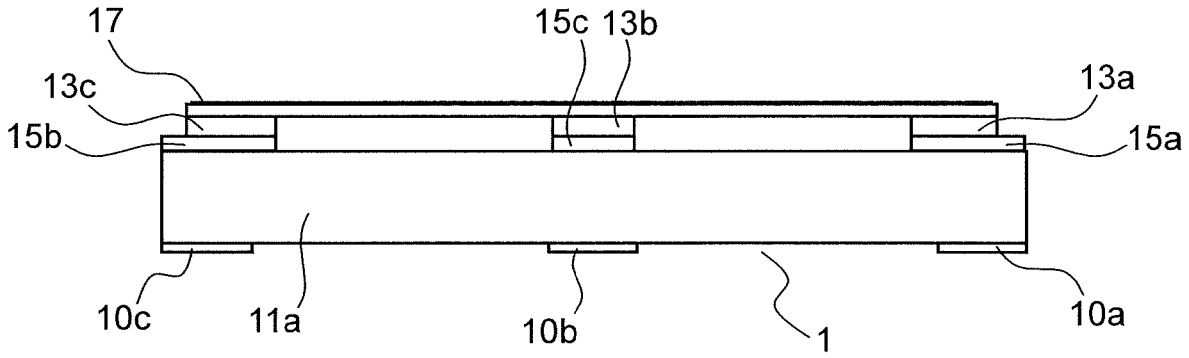
FIG. 11 is a side view of the third structure example of the pallet used in the crating arrangement according to the embodiment as seen from below in FIG. 10.

FIG. 10 is a plan view showing a third structure example of the pallet 1 constituting the crating arrangement 100 according to this embodiment. FIG. 11 is a side view of the third structure example of the pallet 1 as seen from below in FIG. 10. In the third structure example shown in FIGS. 10 and 11, a flat board 15*c* is fixed to central parts of the leg beams 11*a* to 11*c* so as to bridge them. Opposite end parts of the flat board 15*c* in its longitudinal direction protrude from the edges (edges in the up-down direction in FIG. 10) of the support board 17 facing away from each other to positions underlapping the bottom end parts 2*a* of the sleeve 2.

According to the third structure example, in addition to the bottom end parts 2*a* at two sides (two sides in the left-right direction in FIG. 10) of the sleeve 2 facing away from each other, the bottom end parts 2*a* at two sides (two sides in the up-down direction in FIG. 10) orthogonal to the above-mentioned two sides are also supported each at three places of opposite end parts and a central part, on the flat boards 15*a*, 15*b*, and 15*c*. Thus, it is possible to prevent deformation of the sleeve 2 and loosening of the second fastening belts 4*c* and 4*d* resulting from the biting of the bottom end parts 2*a* more effectively than with the second structure example. As in the second structure example, the stepped portions 20 are formed on the pallet 1 at its four edges, and thus it is easy to position the sleeve 2 with respect to the pallet 1.

The embodiments described above are in no way meant to limit the present disclosure, which thus allows for many modifications and variations within the spirit of the present disclosure. For example, although in the above-described embodiment, a pallet 1 and a top board 3 which are made of wood are used, instead, a pallet 1 and a top board 3 which are made of metal or synthetic resin may be used. When the pallet 1 and the top board 3 are molded from metal or resin, for example, the pallet 1 may be formed integrally with the flat boards 15*a* to 15*c* and the stepped portions 20, and the top board 3 may be formed integrally with the engagement pieces 3*a*.

The present disclosure is applicable to crating arrangements in which a large and heavy product is crated. Based on the present disclosure, it is possible to provide a crating arrangement that can reliably protect a crated object and that achieves easy crating and uncrating with use of a small amount of wood.

What is claimed is:

1. A crating arrangement, comprising:

a pallet having a rectangular shape in a plan view, the pallet including:

a bottom board;

a plurality of beams fixed to a top surface of the bottom board; and a support board fixed to top surfaces of the beams;

a sleeve made of a cardboard sheet in a shape of a cornered column, the sleeve being placed over a top surface of the pallet to wrap a side surface of a crated object placed on the support board;

a top board having a rectangular shape, the top board being placed on a top end part of the sleeve; and a plurality of fastening belts with which the pallet and the crated object are fastened together and the pallet, the sleeve, and the top board are fastened together, wherein the beams are formed in a shape of a lattice by comprising a plurality of leg beams arranged parallel to each other on the bottom board and a plurality of horizontal beams arranged on top surfaces of the leg beams so as to bridge the leg beams in a direction orthogonal to the leg beams, along at least two sides of the top surface of the pallet facing away from each other, flat portions which protrude outward beyond a bottom end part of the sleeve are formed by flat boards which are fixed to opposite end parts of the lea beams respectively so as to bridge the leg beams and each of which has a side edge in a longitudinal direction thereof protruding, along an edge of the support board, outward beyond the bottom end part of the sleeve, stepped portions including vertical surfaces which engage with an inner circumferential edge of the sleeve are formed respectively by combination of the horizontal beams fixed to top surfaces of the flat boards and the support board fixed to top surfaces of the horizontal beams, by the horizontal beams and the flat boards, a clearance is formed between the support board and the leg beams, in a side surface of the pallet, arm insertion holes are formed surrounded by the bottom board, the leg beams, and the horizontal beams, and the fastening belts comprise a first fastening belt which passes through the clearance to fasten the pallet and the crated object together, and a second fastening belt which passes through the arm insertion holes to fasten the pallet, the sleeve, and the top board together.

2. The crating arrangement of claim 1, wherein the flat boards each have opposite end parts in the longitudinal direction protruding from edges of the support board facing away from each other outward beyond the bottom end part of the sleeve.

3. The crating arrangement of claim 2, wherein the flat boards are fixed at three or more places including opposite end parts and a central part of the leg beams so as to bridge the leg beams, and the opposite end parts of each of the flat boards in the longitudinal direction protrude from the edges of the support board facing away from each other outward beyond the bottom end part of the sleeve.

4. The crating arrangement of claim 1, wherein on a reverse side of the top board, an engagement piece is provided which engages with an inner circumferential edge of the sleeve.

5. The crating arrangement of claim 1, wherein the cardboard sheet which forms the sleeve has a grain direction thereof aligned parallel to an up-down direction of the sleeve.

* * * * *